US010094083B2

(12) United States Patent
Wuillemin et al.

(10) Patent No.: US 10,094,083 B2
(45) Date of Patent: Oct. 9, 2018

(54) SNOW-CLEARING VEHICLE WITH A SWEEPER-BLOWER ARRANGEMENT

(71) Applicant: Marcel Boschung AG, Payerne (CH)

(72) Inventors: Kurt Wuillemin, Villars-sur-Glâne (CH); Kurt Herzog, Kleinbösingen (CH)

(73) Assignee: Marcel Boschung, AG, Payerne (CH)

( * ) Notice: Subject to any disclaimer, the term of this patent is extended or adjusted under 35 U.S.C. 154(b) by 268 days.

(21) Appl. No.: 14/991,333

(22) Filed: Jan. 8, 2016

(65) Prior Publication Data

US 2016/0201279 A1 Jul. 14, 2016

(30) Foreign Application Priority Data

Jan. 12, 2015 (EP) ..... 15000052

(51) Int. Cl.

| | |
|---|---|
| ***E01H 1/08*** | (2006.01) |
| ***E01H 5/09*** | (2006.01) |
| ***E01H 6/00*** | (2006.01) |

(52) U.S. Cl.

CPC ..... *E01H 1/0818* (2013.01); *E01H 5/092* (2013.01); *E01H 5/098* (2013.01); *E01H 6/00* (2013.01)

(58) Field of Classification Search

CPC ..... E01H 1/0818; E01H 5/092; E01H 5/098; E01H 6/00

See application file for complete search history.

(56) References Cited

U.S. PATENT DOCUMENTS

| | | | | | |
|---|---|---|---|---|---|
| 1,033,164 | A | * | 7/1912 | Fahrney | A47L 5/14 15/345 |
| 3,007,191 | A | * | 11/1961 | Braun | E01H 1/0872 15/340.3 |
| 3,766,586 | A | * | 10/1973 | Krickovich | E01H 1/0845 15/340.3 |
| 4,226,034 | A | * | 10/1980 | Benjamin | E01H 5/106 126/271.2 C |
| 4,256,261 | A | * | 3/1981 | Gurney | E01C 23/166 239/112 |
| 4,271,617 | A | * | 6/1981 | Yoshizawa | E01H 1/101 239/754 |
| 4,404,762 | A | * | 9/1983 | Munsterer | E01H 4/02 239/14.2 |
| 4,538,369 | A | * | 9/1985 | Pasquier | E01H 4/02 239/14.2 |

(Continued)

FOREIGN PATENT DOCUMENTS

| | | |
|---|---|---|
| DE | 3335042 | 4/1985 |
| EP | 0189371 | 7/1986 |
| EP | 0288436 | 10/1988 |

*Primary Examiner* — Jamie L McGowan

(74) *Attorney, Agent, or Firm* — Cooper & Dunham LLP

(57) ABSTRACT

Snow-clearing vehicle (1), having a sweeper-blower arrangement (10), wherein the sweeper-blower arrangement is adjustably pivotable around a vertical axis (13) which runs through the snow-clearing vehicle. The sweeper-blower arrangement has a sweeping-roller brush (4) which is rotatingly drivable around its longitudinal axis. In the direction of travel, blow-air openings (5, 6, 7, 8) arranged on both sides of the vertical axis are provided in front and along the sweeping-roller brush (4), which are arranged for simultaneous and identically acting blowing. This allows for an improved removal of the snow to be cleared.

21 Claims, 9 Drawing Sheets

(56) References Cited

U.S. PATENT DOCUMENTS

| | | | | | |
|---|---|---|---|---|---|
| 4,707,879 | A * | 11/1987 | Moszkowski | A47L 5/14 | 15/345 |
| 4,858,270 | A * | 8/1989 | Boschung | E01H 1/0818 | 15/328 |
| 5,515,623 | A * | 5/1996 | Weeks | E01H 5/066 | 239/159 |
| 5,884,359 | A * | 3/1999 | Libhart | E01H 1/0872 | 15/340.3 |
| 6,195,836 | B1 * | 3/2001 | Vanderlinden | A47L 11/24 | 15/340.3 |
| 6,371,565 | B1 * | 4/2002 | Libhart | B60P 1/34 | 15/83 |
| 7,017,226 | B2 * | 3/2006 | Ikeda | B08B 1/04 | 15/308 |
| 7,108,196 | B2 * | 9/2006 | Kime | E01H 10/007 | 239/1 |
| 7,191,485 | B1 * | 3/2007 | Ramer | A01G 1/125 | 15/34 |
| 7,621,018 | B2 * | 11/2009 | Libhart | E01H 1/0863 | 15/340.1 |
| 9,060,659 | B2 * | 6/2015 | Lu | A47L 9/009 | |
| 9,605,395 | B1 * | 3/2017 | Hewitt | E01H 1/0818 | |
| 2006/0272182 | A1 * | 12/2006 | Gertner | E01H 5/104 | 37/227 |

* cited by examiner

SNOW-CLEARING VEHICLE WITH A SWEEPER-BLOWER ARRANGEMENT

CROSS REFERENCE TO RELATED APPLICATIONS

This application claims the priority of European patent application 15 000 052.9, filed Jan. 12, 2015, the disclosure of which is incorporated herein by reference in its entirety.

FIELD OF THE INVENTION

The invention relates to a snow-clearing vehicle with a sweeper-blower arrangement, wherein the sweeper-blower arrangement is adjustably pivotable around a vertical axis which runs through the snow-clearing vehicle, and which sweeper-blower arrangement has a sweeping-roller brush, rotatingly drivable around its longitudinal axis, as well as a plurality of blow-air openings which are arranged in the direction of travel in front of and along the sweeping-roller brush on both sides of the vertical axis. The invention further relates to a method for operating a sweeper-blower snow-clearing vehicle for snow removal.

BACKGROUND

From EP-A-0 189 371, a snow-clearing vehicle is known which has an outlet opening for blow-air each on one end of the sweeping-roller brush. Depending on the position of the sweeping-roller brush, one or the other outlet opening is activated, and so an airstream is generated from the corresponding end of the sweeping-roller brush for removing snow. EP-A-0 288 436 shows a snow-clearing vehicle according to the above field, in which a blow-air opening on the end and in the center are activated in front of the sweeping-roller brush in the setting of the sweeper-blower arrangement provided for snow removal. If the aim is to blow the snow to the other side of the sweeper-blower arrangement, two blow-air openings, which face in opposite directions, are activated and the aforementioned blow-air openings are deactivated. Such snow-clearing vehicles have proved to be successful. They are used particularly for snow removal on runways for airplanes, where large amounts of snow have to be removed quickly. A sweeping machine is as well shown in U.S. Pat. No. 3,007,191 and in DE 33 35 042 A1.

PRESENTATION OF THE INVENTION

The invention addresses the problem of providing an improved snow-clearing vehicle. In particular, the aim is to safely and even quicker remove snow from an even larger surface during travel in one direction.

This problem is solved by a snow-clearing vehicle of the initially described type wherein the sweeper-blower arrangement is designed such that blow-air openings arranged on both sides of the vertical axis can be operated for blowing air simultaneously and in an equal or identical manner, respectively, having thus the same effect.

The blow-air openings are understood to acting equally or identically, respectively, if they act by blowing the snow to the same clearing side, either to the right side of the vehicle or to the left side of the vehicle. It has shown that with the improved, achievable blow-air distribution, particularly the more even blow-air distribution along the sweeping-roller brush, a significantly improved removal of the snow left behind by the plow or the snow loosened by the sweeping-roller brush can be achieved. This leads to an improved sweeping result, particularly at high driving speeds. The improved removal of snow by the aligned and identically acting blow-air openings on both sides of the center of the sweeping-roller brush or on both sides of the vertical axis also makes it possible to angle the sweeping-roller brush to a lesser degree, resulting in an enlargement of the work surface. It is further advantageous that, due to a plurality of blow-air openings along the sweeping-roller brush, a greater air volume at a slower speed can be achieved than with the known solution, having only one or two blow-air openings on one side. These have to operate with very high air speed in order to achieve good results. This also increases the risk that snow thrown far away laterally damages airplanes or vehicles or stationary facilities. The solution according to the invention with a plurality of blow-air openings which can be operated simultaneously and identically acting on both sides of the center largely prevents the risk of such damage. Identically or equally acting, respectively, refers to the movement of the snow in the same general direction to the left or to the right as seen from the snow-clearing vehicle and, in other words, the blowing of the blow-air openings not being directed toward each other.

It is preferred that in a snow-clearing vehicle, two or more blow-air openings are provided on each side of the vertical axis which can generate a blow-airstream along the sweeping brush and act in an equal manner. For a sweeping-roller brush with a length of 4 to 6 meters, four blow-air openings along the brush are preferred; for a sweeping-roller brush with a length of more than 6 meters, more than four and particularly six blow-air openings are preferably provided and arranged to act simultaneously and in an equal manner. Particularly with sweeping-roller brushes of such size, for which a continuous uniform pressing against the ground to be cleared is not easy to control, a plurality of blow-air openings on both sides of the vertical axis can significantly improve snow removal. If necessary, it is possible to provide only three blow-air openings, wherein one blow-air opening each is provided on one side of the roller brush and one blow-air opening is provided in the middle of the roller brush or on the vertical axis.

It is preferred that the blow-air openings are substantially spaced apart evenly. The large number of blow-air openings along the sweeping-roller brush spaced apart from each other evenly makes it possible particularly well to generate an airstream that is effective consistently over the entire length of the sweeping-roller brush. It is further preferred that the blow-air openings are arranged pivotably either individually or in groups for changing their blowing direction. The angle of the respective blow-airstream to the longitudinal axis of the sweeping-roller brush can thus be adjusted in a horizontal plane. This allows in a simple manner also for the adjustment of the blow-air openings to the changed direction of removal, when an adjustment is made from removal on the right to removal on the left (with corresponding realignment of the snowplow and the sweeping-roller brush). The pivotability of the blow-air openings also allows for different adjustment of the airstream along the sweeping-roller brush even at a constant direction of removal. The snow can thus be removed more purposefully from the sweeping-roller brush. Each blow-air opening can be adjusted individually, or if necessary, also together in groups of blow-air openings. The adjustment can be made mechanically or manually or by means of an electric motor or a hydraulic drive. In particular, the adjustment can be diverted by means of a mechanical arrangement from the pivoting movement of the sweeping-roller brush and/or mechanically transferred from said sweeping-roller brush to the blow-air openings, for example, by means of a rod system arrangement. In particular, the adjustment can also be determined by an electronic control device. This allows in a simple manner to provide different blow-air distributions for different removal requirements. If the blow-air openings are not arranged pivotably, a second arrangement of blow-air openings with opposite blowing direction must be provided for adjusting the blowing direction to the right or to the left.

It is also possible to provide a tilting of the blow-air openings towards or away from the surface to be cleared; otherwise, the angle of the blow-air openings is non-adjustable. It can be the same for all blow-air openings or different for individual blow-air openings.

A further preferred embodiment is that of blow-air openings, individually or in groups, being slidably arranged along the sweeping-roller brush. With the shifting along or substantially parallel to the longitudinal axis of the sweeping-roller brush, it is also possible to affect the blow-airstream. It is particularly advantageous if the outermost or first blow-air opening in blow-air direction is slidable such that it is eventually positioned outside the area which is covered by the sweeping-roller brush. As a result, the blow-airstream is effective on the entire length of the sweeping-roller brush. In a preferred embodiment, two or three blow-air openings each are arranged on each side of the vertical axis on a common carrier, wherein the corresponding carrier is slidable along the sweeping-roller brush and the corresponding blow-air openings are arranged pivotably on the carrier. This results in a constructively simple solution with which the aforementioned advantages of pivoting and sliding can be achieved.

It is further preferred that at least one blow-air opening is additionally arranged in the direction of travel behind the sweeping-roller brush, particularly, that at least two pivotable blow-air openings are arranged behind the sweeping-roller brush.

The snow-clearing vehicle can be a vehicle with its own drive and a snowplow in the front. Alternatively, the snow-clearing vehicle can be a pullable vehicle without its own drive, and so it is pulled along as trailer behind a vehicle with a snowplow. A preferred alternative particularly for such a case is that of the blow-air being generated separately for one group of blow-air openings each.

The invention further addresses the problem of providing improved snow removal with a sweeper-blower clearing vehicle.

This problem is solved with a method for operating a sweeper-blower clearing vehicle in that an airstream is generated from overlapping individual blow-airstreams by at least four blow-air openings along the sweeping-roller brush, each acting in an equal manner and simultaneously and each emitting a blow-airstream.

It has showing that with the thus achieved and improved, particularly more even blow-air distribution along the sweeping-roller brush, a significantly improved removal of the snow left behind by the plow or the snow loosened by the sweeping-roller brush can be achieved. This leads to an improved sweeping result. The improved removal of the snow by the aligned blow-air openings, which are acting in an identical or equal manner, respectively, along the sweeping-roller brush or on both sides of the vertical axis also makes it possible to angle the sweeping-roller brush to a lesser degree, resulting in an enlargement of the work surface. It is further advantageous that, due to a plurality of blow-air openings along the sweeping-roller brush, a greater air volume at a slower speed can be achieved than with the known solutions, which have only one or two blow-air openings on one side. These have to operate with very high air speed in order to achieve good results. This also increases the risk that snow thrown far away laterally damages airplanes or vehicles or stationary facilities. The solution with the more than two blow-air openings which can be operated simultaneously and are identically acting on both sides of the center of the sweeping-roller brush results in a diminished risk of such damage.

The blow-air openings are preferably arranged substantially at the same distance from each other along the sweeping-roller brush and are operated such that it results in the best possible even, combined blow-airstream along the sweeping-roller brush. A further preferred operating type is that of pivoting at a greater angle in the direction of travel those blow-air openings which are located at the end of the blow-airstream, particularly the two last blow-air openings in order to deposit the snow more purposefully against the airstream caused by driving. It is preferred that different positions of the blow-air openings are stored in and retrievable from an electronic control of the snow-clearing vehicle.

BRIEF DESCRIPTION OF THE DRAWINGS

Further embodiments, advantages, and uses of the invention follow from the dependent claims and from the following description using the drawings:

WAY(S) TO REALIZE THE INVENTION

Figure 1:
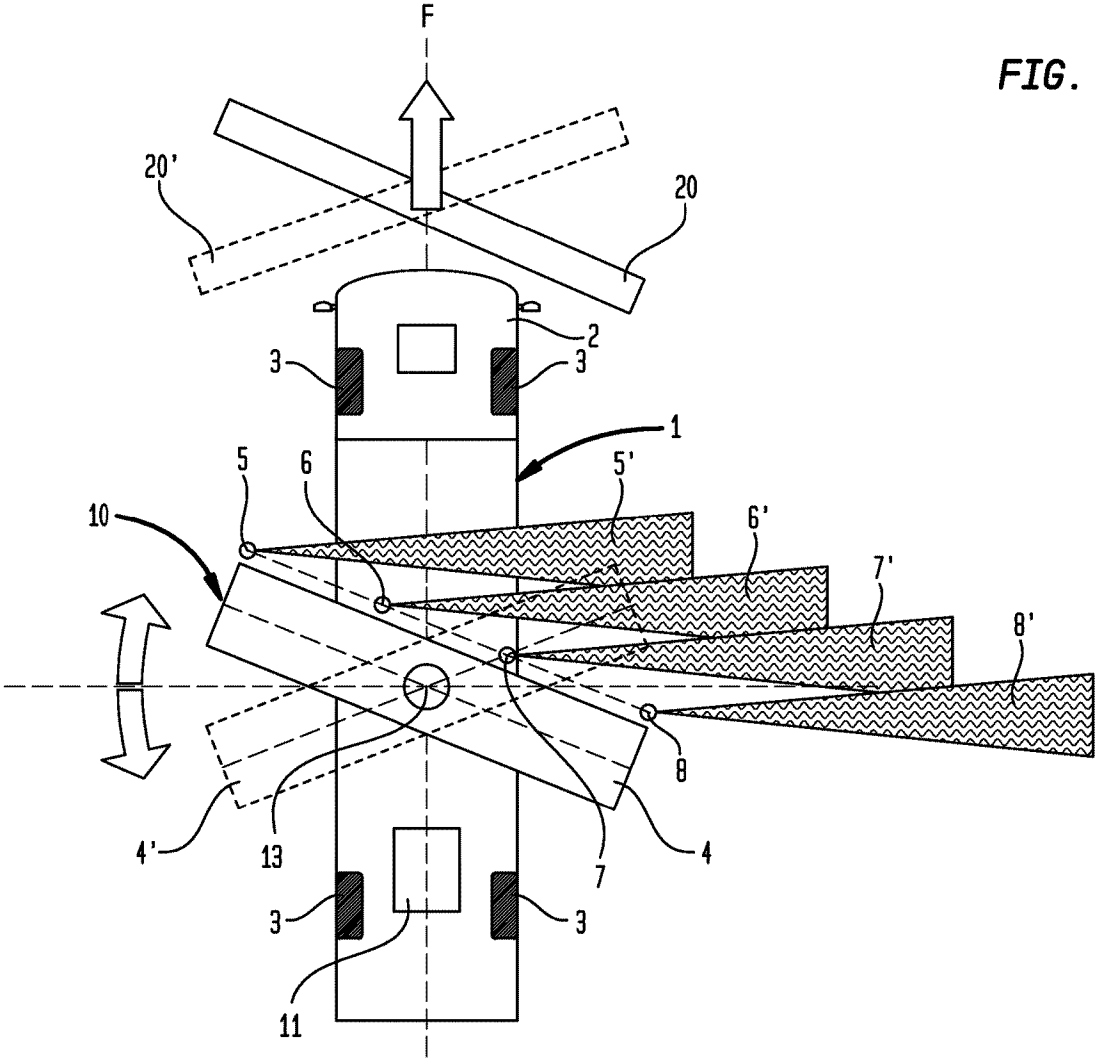
FIG. 1 shows schematically a top view of an embodiment of a snow-clearing vehicle.

FIG. 1 and further drawings show a schematic top view of a self-propelled snow-clearing vehicle 1. The vehicle sits on the surface, on which the snow to be cleared is located and which, for example, is a runway of an airport, and the vehicle travels in the direction of the arrow F for removing snow. The vehicle is schematically indicated with a driver's cabin 2 and the wheels 3. Such a vehicle has the drives for all the driving and snow removal functions usual for snow-clearing vehicles which will not be further explained herein. The vehicle is equipped with a snowplow 20 which will also not be explained further since this is known to a person skilled in the art of snow-clearing vehicles. FIG. 1 shows the snowplow 20 in the position for clearing snow to the right in the drawing and denoted with 20' as a dotted line in order to indicate the position in which the snowplow has been brought to the left in the figure. The vehicle is further equipped with a sweeper-blower arrangement 10, having a sweeping-roller brush 4 which is pivotable around a vertical axis 13. Such sweeper-blower arrangements with a sweeping-roller brush and their pivotability are known to a person skilled in the art, and the pivot mounting and the drive for rotating the brush shall not be further explained herein. Along its longitudinal axis, the brush can be formed as one piece or from a plurality of parts. FIG. 1 shows the sweeping-roller brush 4 in the position which is suitable for the position of the plow 20 or the removal of snow to the right in the drawing. The sweeping-roller brush 4' as dotted depiction indicates the position for removing snow to the left.

Figure 7:
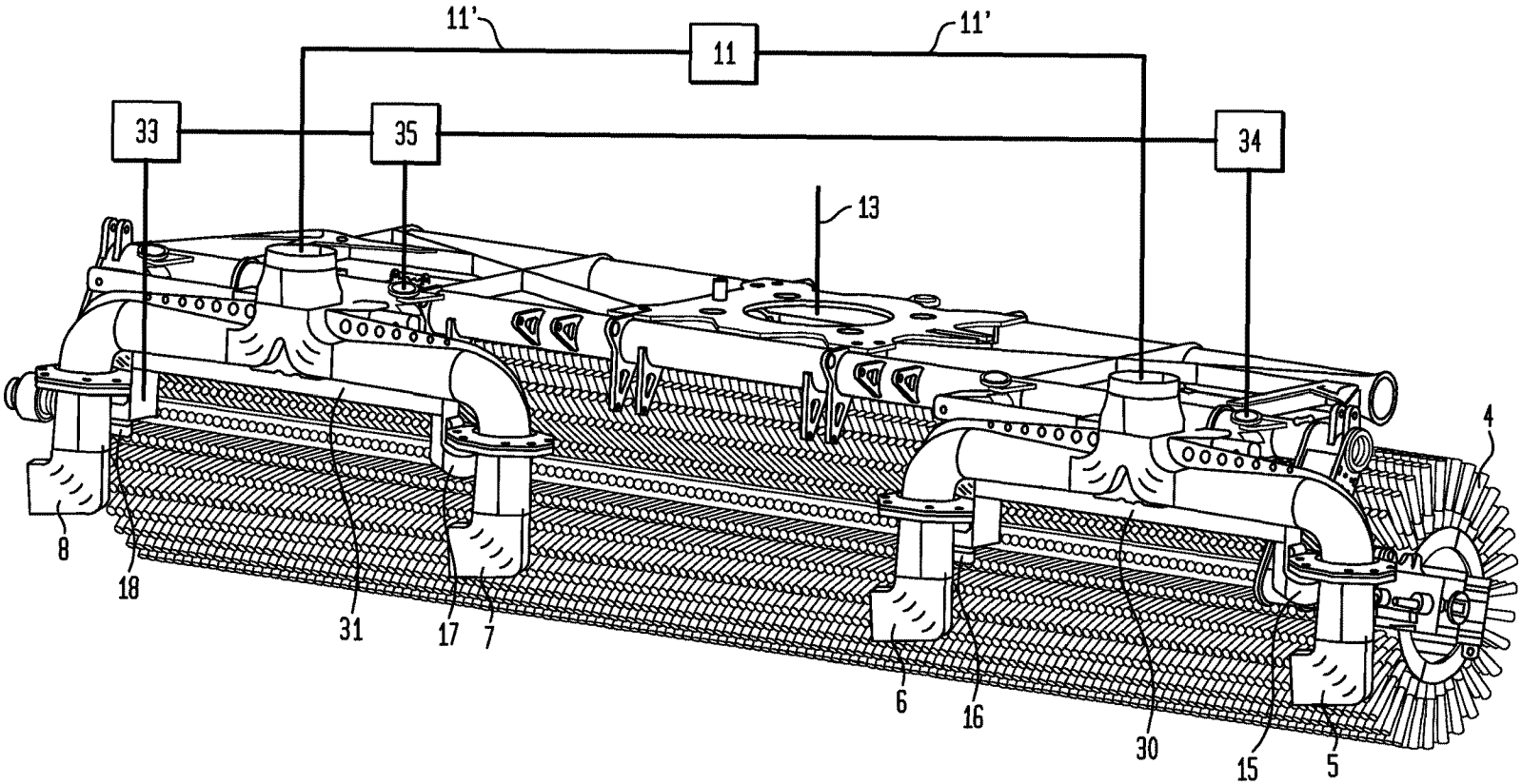
FIG. 7 shows a diagrammatic depiction of a sweeper-blower arrangement with a common carrier for two blow-air openings each.
Figure 8:
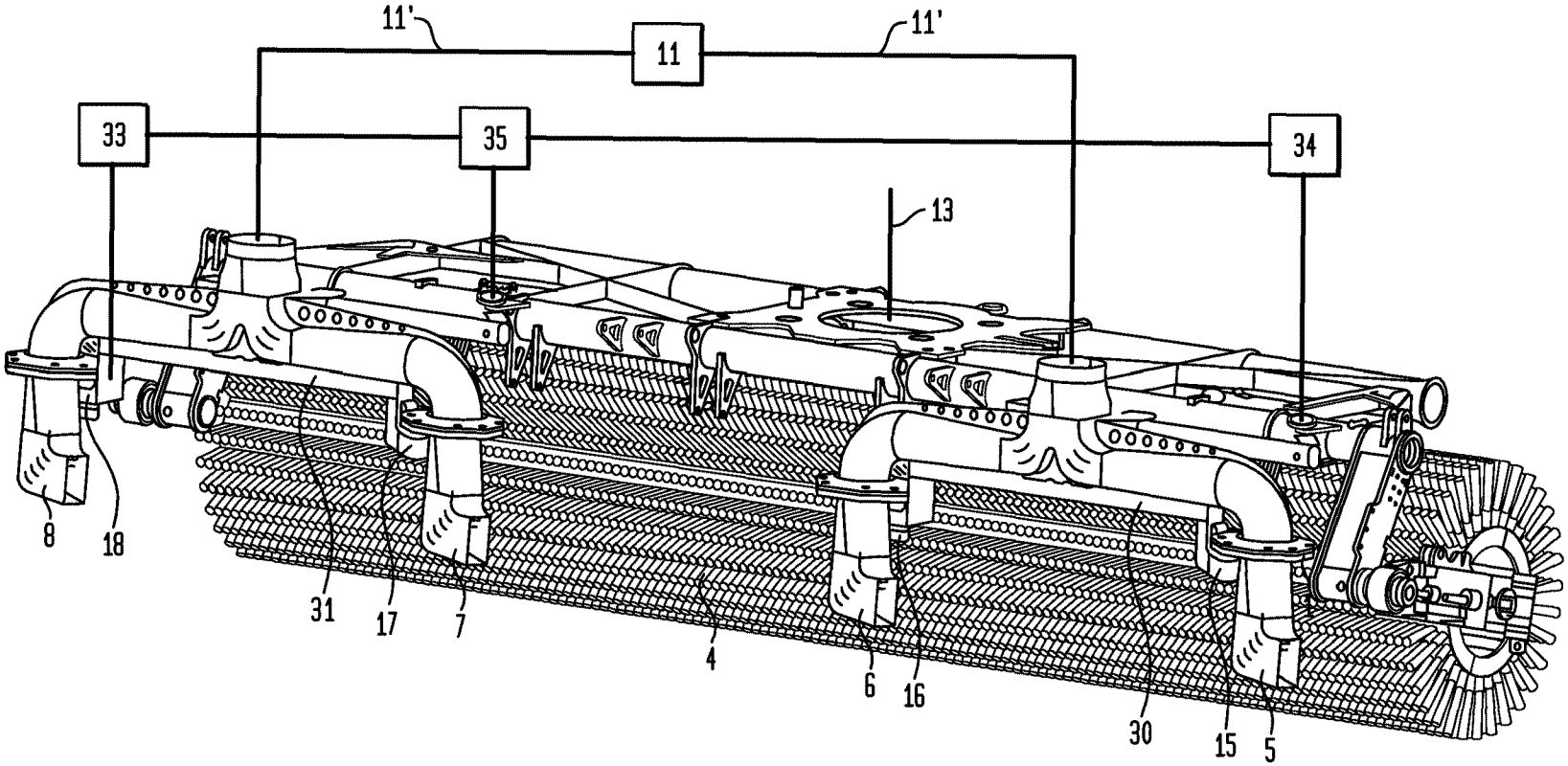
FIG. 8 shows the example from FIG. 7 with a different position of the carriers.

In the schematic depiction of FIG. 1 and further drawings, the blow-air openings of the sweeper-blower arrangement provided for blowing air are merely indicated as circles. A person skilled in the art knows the design of the blow-air openings as simple round or square openings of a pipe, or as nozzle-shaped outlet of a pipe, or on a pipe which usually let the blow-air emerge horizontally. FIGS. 7 and 8 show an example in more detail. The blow-air openings are connected by means of pipelines, which are not depicted, to a device 11 for generating air under pressure or, as a result, a stream of air, respectively. This device 11 can have any type of design known to a person skilled in the art and can, for example, be an electrically driven radial blower.

According to the invention, openings for blowing air out from the sweeper-blower arrangement or, in other words, blow-air openings are arranged on both sides of the vertical axis 13 along the sweeping-roller brush 4 and are provided for emitting blow-air in an essentially identical manner, or in other words, in a manner that leads to air streams that work in essentially the same direction. This is depicted in FIG. 1 with an example of four blow-air openings 5, 6, 7, and 8. It is also possible to provide only three blow-air openings, or it is also possible to provide more than four blow-air openings. The blow-air openings are acting identically by blowing the snow to the same clearing side, i.e. either to the left or to the right. With the indicated conical airstreams 5' (from the blow-air opening 5) and 6' (from opening 6) and 7' (from opening 7) and 8' from the blow-air opening 8, the blowing of the snow to the right is depicted which also corresponds to the position of the plow 20 and the sweeping-roller brush. The equally or identically, respectively, acting airstreams which are generated along the sweeping-roller brush result in the positive effects described with the advantages of the invention. In particular, it is possible to set the sweeping-roller brush at a less acute angle, resulting in a greater clearing width. This is shown schematically in FIG. 10 with the angles $\alpha'$ and $\alpha''$ for two different positions of the sweeping brush, wherein the smaller angle $\alpha'$ results in the greater clearing width $\alpha'$ of the sweeping brush 4 when compared to the greater angle $\alpha''$ which results in the smaller clearing width $\alpha''$.

Figure 2:
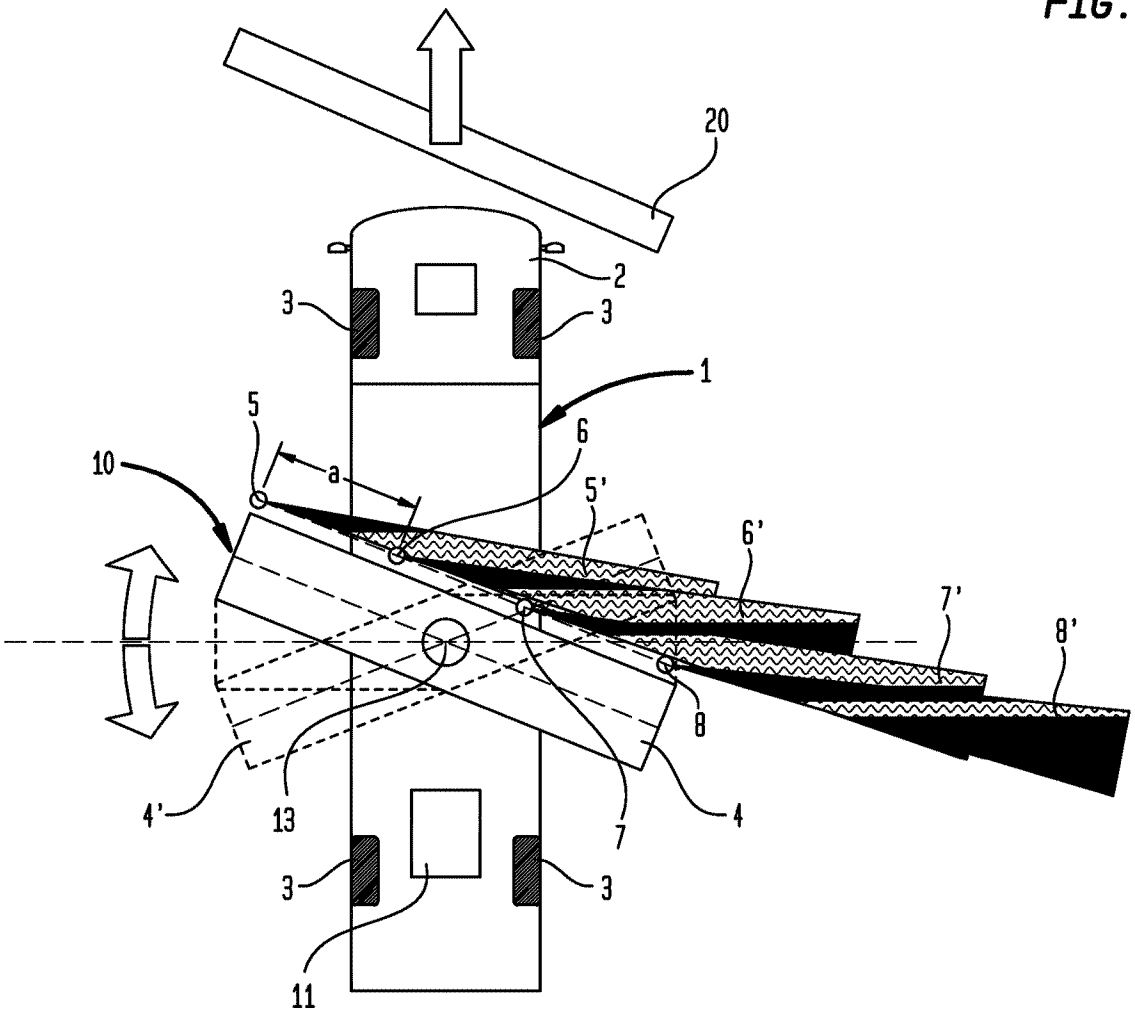
FIG. 2 shows a schematic top view according to FIG. 1 with a preferred setting of the blow-air openings.

While the basic configuration with a plurality of identically acting blow-air openings was depicted using FIG. 1, FIG. 2 shows a preferred setting, in which the blow-air openings are arranged such that their airstreams 5', 6', 7', and 8' and their effective ranges overlap. It is also preferred that all or some of the blow-air openings along the sweeping-roller brush are at the same distance "a" from each other.

The blow-air openings are preferably arranged pivotably, and therefore are pivotable from the position according to FIG. 1 to the position according to FIG. 2. In such case, a pivot axis is provided for each blow-air opening which allows for the appropriate rotation and thus adjustment of direction of the conical airstream. The pivoting can be motor-driven, and it can be affected by an electronic control, adjusted to the position of the sweeping-roller brush 4 and also to the plow 20. It is clearly apparent from FIG. 2 how the exemplarily operated blow openings allow for the removal of the snow in a particularly satisfactory manner.

Figure 3:
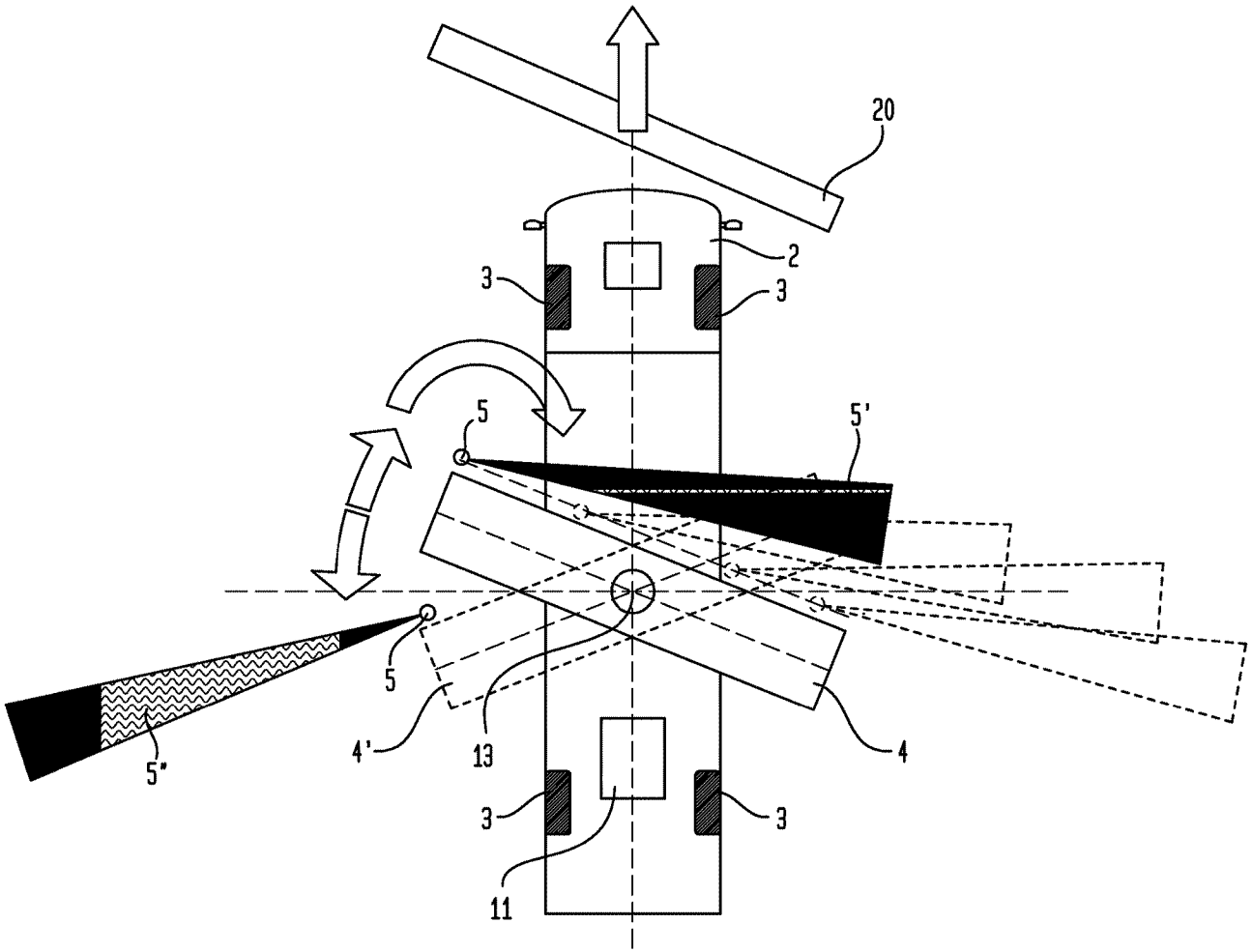
FIG. 3 shows a further schematic top view of the snow-clearing vehicle of FIG. 1 for illustrating the pivotability of the blow-air openings.

For explanation purposes only, FIG. 3 shows the position for snow removal to the right and as well the position for snow removal to the left. Of course, either of the two positions is selected when removing snow along the track of the vehicle. For simplifying the drawing, it is only shown for the blow-air opening 5 and its airstream 5' that during pivoting of the sweeping-roller brush 4 to the position denoted with reference sign 4', the blow-air opening 5 is also rotated together with the sweeping-roller brush 4 and additionally pivoted to the position, ensuring that its airstream proceeds as depicted with reference sign 5", and so the snow is blown to the left. Correspondingly, this would also apply to the blow-air openings 6, 7, and 8. Alternatively to such pivotable blow-air openings, an additional set of blow-air openings can also be provided, the blowing direction of which is directed in the opposite direction of the blow-air openings 5-8, and so this additional set of blow-air openings is activated and the blow-air openings 5-8 are deactivated, when the sweeping-roller brush 4' is in the pivoted position. This can be achieved with switchable valves or flaps which optionally connects the blow-air generator 11 to one or the other set of blow-air openings.

Figure 4:
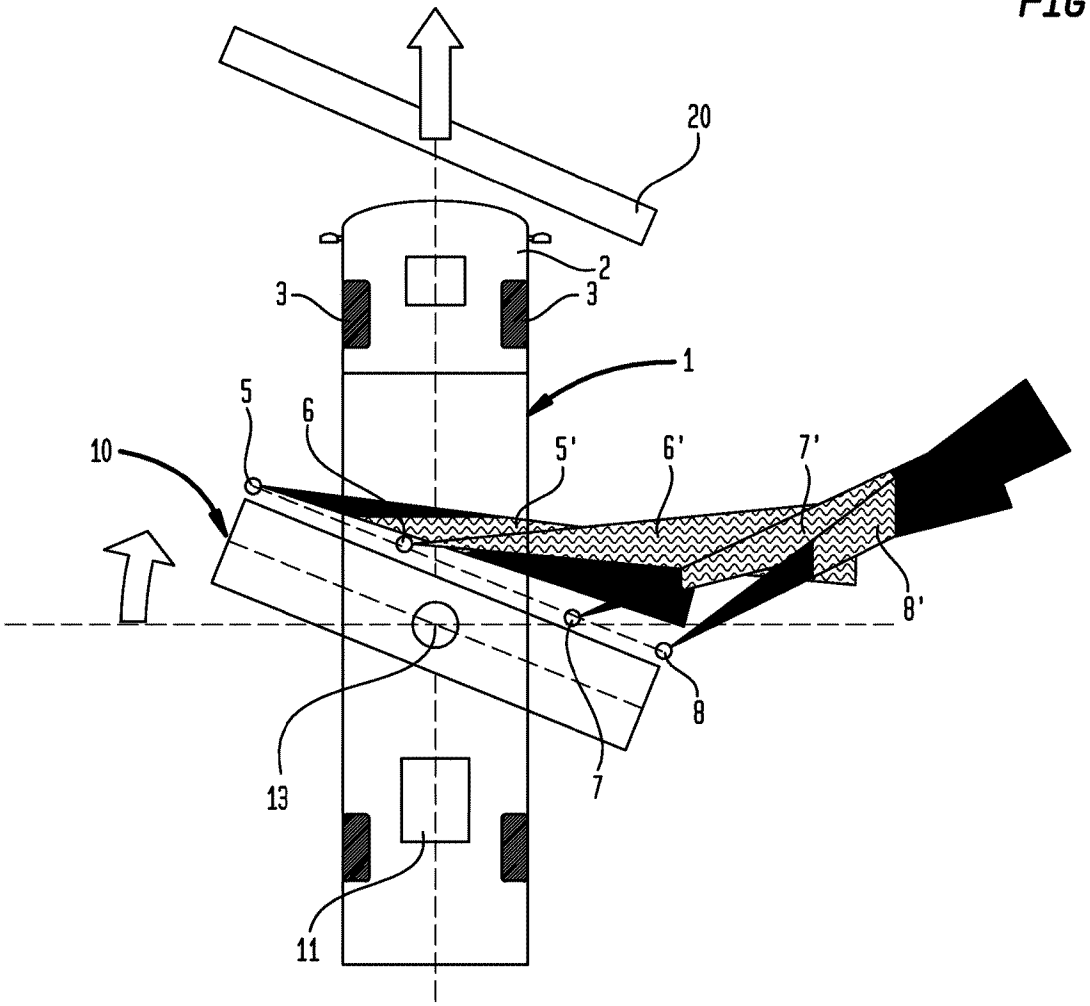
FIG. 4 shows a further top view according to FIG. 1 for illustrating a possible position of the blow-air openings.

FIG. 4 once again shows a schematic top view of the removal of snow to the right. The same reference signs denote the same or functionally similar elements as described above. In FIG. 4, a further operating type is depicted, in which the blow-air openings continue to operate simultaneously and identically in the meaning of the present invention (in this case all of them blow to the right), but are pivoted around different angles. In this example with four blow-air openings, the three blow-air openings 6, 7, 8 positioned further to the right are pivoted by an increasingly greater angle than the blow-air opening 5 positioned on the far left. It is also possible that only the two blow-air openings 7 and 8 are increasingly pivoted, or it is also possible that only the blow-air opening 8 is pivoted relative to the blow-air openings 5, 6, and 7 which are arranged in alignment.

Figure 5:
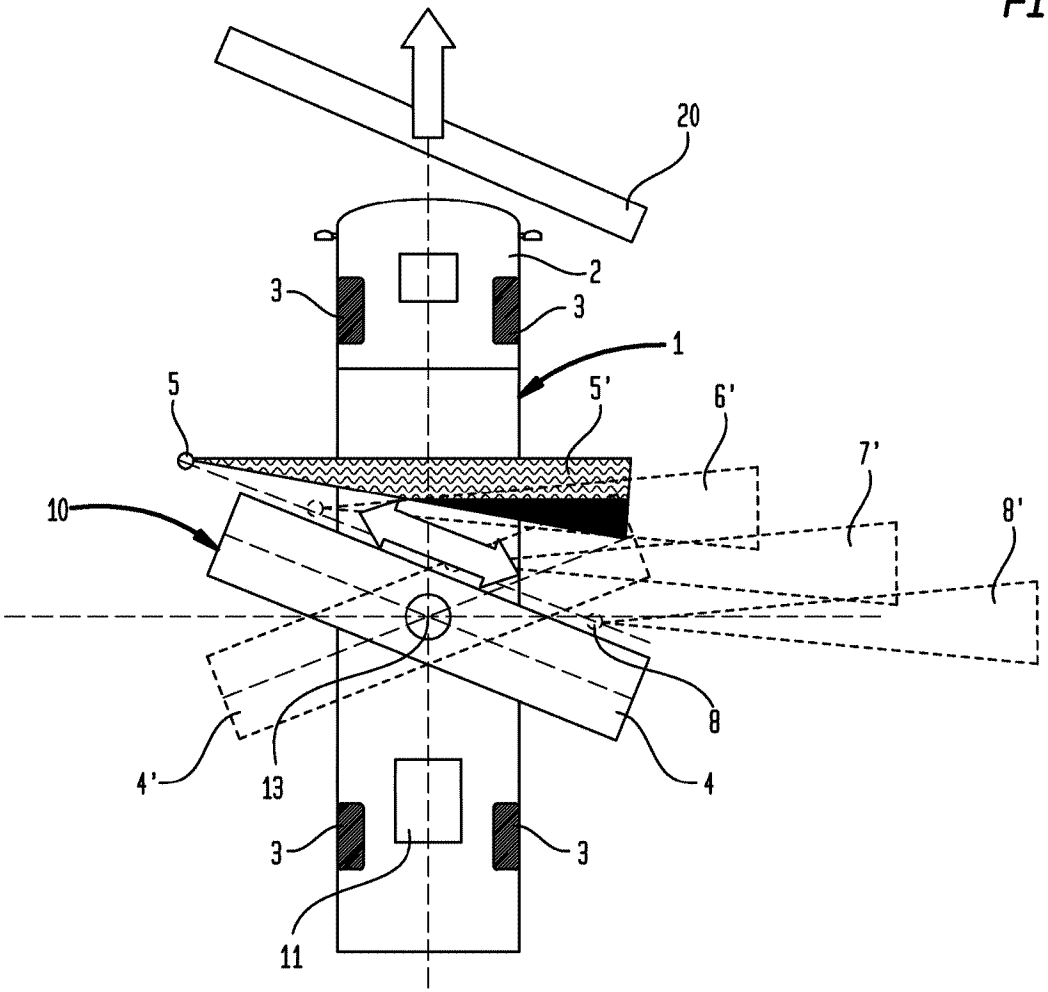
FIG. 5 shows a depiction according to FIG. 1 for illustrating the relocatability of blow-air openings.

FIG. 5 shows a further preferred embodiment, in which at least one blow-air opening is relocatable, or in other words, slidable along the sweeping-roller brush. In the example of FIG. 5, all blow-air openings are depicted as shifted, and so the blow-air opening 5 is eventually positioned outside of the sweeping-roller brush 4. It is also possible that only the blow-air opening 5 was shifted, while the other blow-air openings maintained their positions. For a removal to the left, the blow-air opening 8 would be the blow-air opening which eventually were to be positioned outside of the sweeping-roller brush. The shift makes it possible that the blow-air becomes already effective at the outer end of the sweeping-roller brush.

Figure 6:
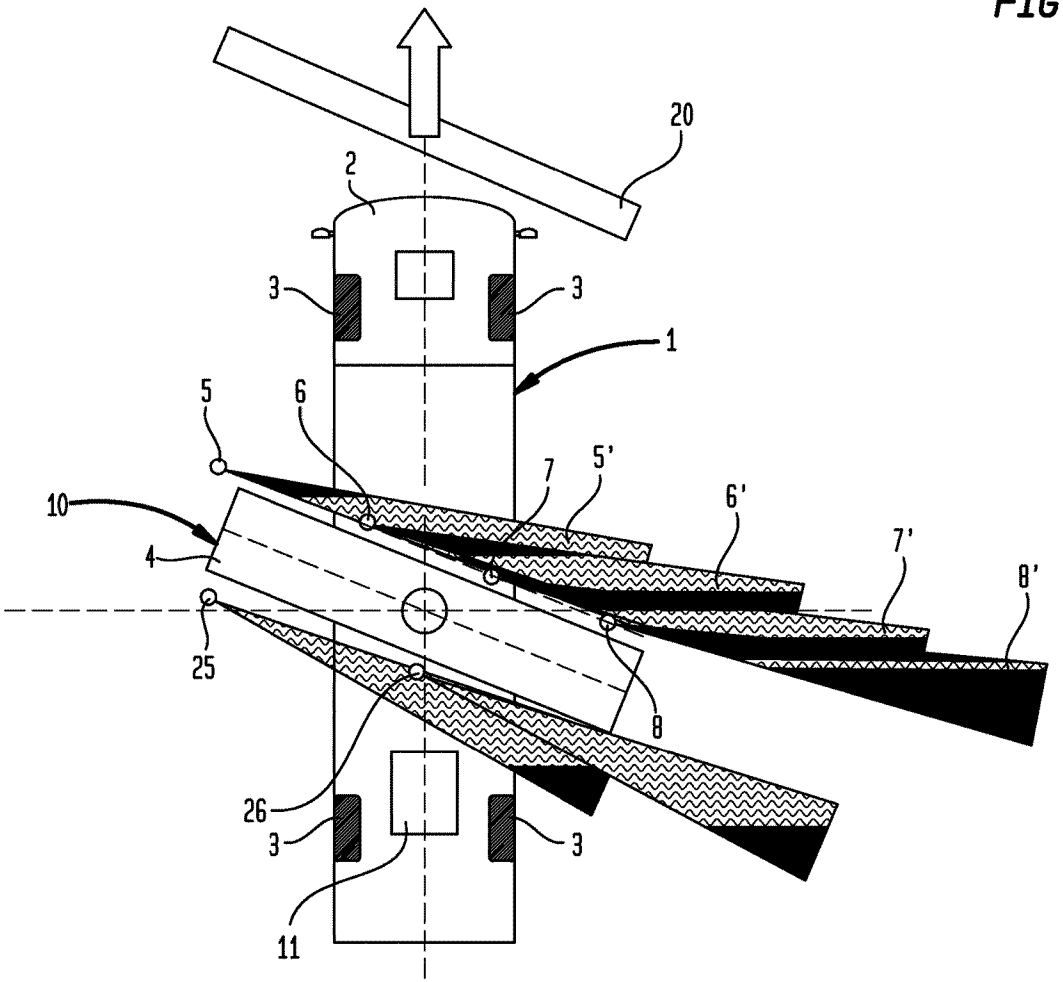
FIG. 6 shows a depiction according to FIG. 1 with blow-air openings behind the sweeping-roller brush.

FIG. 6 shows a further embodiment, in which blow-air openings 25, 26 are provided also in the direction of travel of the vehicle behind the sweeping-roller brush 4. They can be arranged, as depicted, in one half of the sweeping-roller brush or on both sides of the vertical axis. The blow-air openings behind the sweeping-roller brush are preferably also pivotable and, if necessary, also slidable in order to act in the position 4' of the sweeping-roller brush the same way as in the position 4 of FIG. 6.

FIGS. 7 and 8 show a diagrammatic view of a sweeper-blower arrangement with the sweeping-roller brush 4 and four blow-air openings 5 to 8. The view shows the front of the vehicle against the diving direction. The device 11 for generating blow-air is only indicated, similar to its connections 11', which are pipelines or hose lines, to the blow-air openings 5 to 8. In this embodiment, the blow-air openings are arranged in groups of two on a common carrier, each slidable along the sweeping-roller brush. The respective blow-air openings are arranged individually pivotable on the carrier. In FIG. 7, the carriers 30 and 31 are depicted with the blow-air openings 5, 6, and 7, 8 in a position that is not shifted, and the blow-air openings are pivoted for blowing to the right (as seen looking in the direction of travel). The individual swivel drives for the blow-air openings are denoted with 15-18 and can be controlled with the control 33 (only indicated by a box) of the snow-clearing vehicle in order to adjust the pivot angle and the blowing direction. A preferred different embodiment is a mechanical arrangement, for example with a rod system, which mechanically diverts the pivoting of the blow-air openings from the pivoting sweeping-roller brush, and so the blow-air openings are automatically pivoted to the desired position by the mechanical arrangement, when the sweeping-roller brush is pivoted. FIG. 8 shows that the carriers are shifted and the blow-air openings are adjusted for blowing to the left (as seen looking in the direction of travel). FIG. 8 also shows the form of the blow-air openings at the outlet of the blow-air, which in this example is rectangular. The corresponding shifting drive 34, 35 for carrier 30 and 31 is only indicated. These drives can also be controlled by the control 33.

Figure 10:
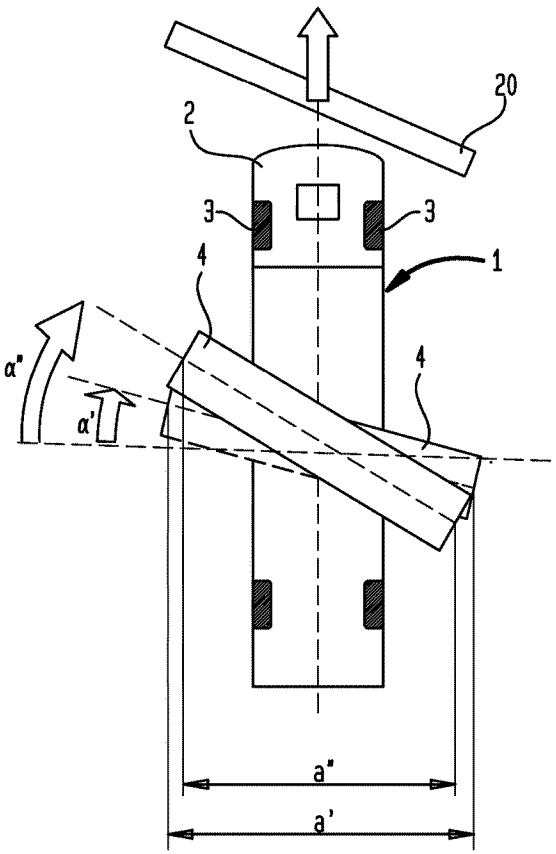
FIG. 10 shows a depiction for illustrating the clearing width of the sweeping brush.
Figure 9:
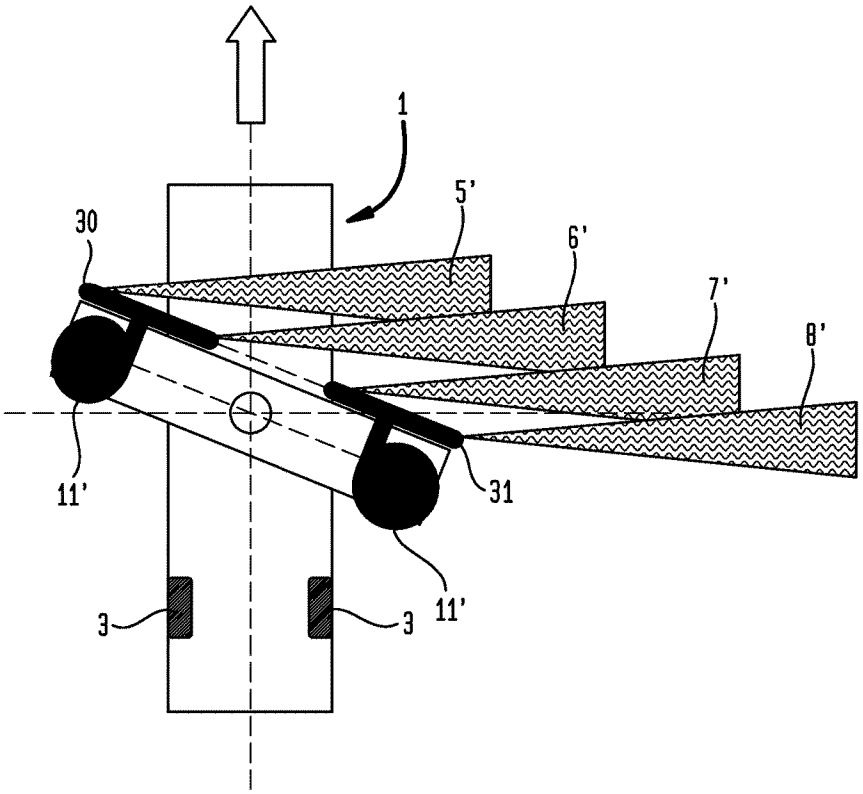
FIG. 9 shows an example of a snow-clearing vehicle without its own drive and for the arrangement of radial blowers.

FIG. 9 shows a further embodiment, in which the snow-clearing vehicle is a vehicle without its own drive and is pulled by another vehicle. As a rule, the other vehicle is a snowplow. In FIG. 9, the same reference signs once again denote the same or functionally similar elements. This embodiment shows as an example that, instead of a central device for generating blow-air, two separate devices 11' and 11" can be provided, each associated with a group of blow-air openings. In this case, they are the blow-air openings arranged on a common carrier 30 and 31 which are merely indicated in the drawing with their blow-air cones 5'-8'. The devices 11' and 11" can be, for example, electrically or hydraulically driven radial fans. The design for generating blow-air in FIG. 9 could also be provided in a self-propelled vehicle according to FIGS. 1 to 6. FIG. 10 has already been explained above.

While preferred embodiments of the invention are described in the present application, it must be clearly pointed out that the invention is not limited to these embodiments and can also be designed in a different manner within the scope of the following claims.

The invention claimed is:

1. Snow-clearing vehicle with a right clearing side and a left clearing side, having a sweeper-blower arrangement, wherein the sweeper-blower arrangement is adjustably pivotable around a vertical axis which runs through the snow-clearing vehicle, and wherein the sweeper-blower arrangement is provided with a sweeping-roller brush which is rotatingly drivable around its longitudinal axis, as well as with a plurality of blow-air openings arranged in the direction of travel in front and along the sweeping-roller brush on both sides of the vertical axis, wherein the sweeper-blower arrangement provides blow-air openings arranged on both sides of the vertical axis which are provided for simultaneous, identically acting blowing such that all said blow air openings on both sides of the vertical axis act by blowing snow to the same clearing side of the vehicle.

2. Snow-clearing vehicle according to claim 1, wherein two or more blow-air openings are provided on each side of the vertical axis.

3. Snow-clearing vehicle according to claim 1, wherein for a sweeping-roller brush with a length of 4 to 6 meters at least four blow-air openings are provided, and wherein for a sweeping-roller brush with a length of more than 6 meters at least six blow-air openings are provided.

4. Snow-clearing vehicle according to claim 2, characterized in that the blow-air openings are substantially evenly spaced apart from each other.

5. Snow-clearing vehicle according to claim 1, wherein the blow-air openings are pivotably arranged individually or in groups for changing their blowing direction.

6. Snow-clearing vehicle according to claim 1, wherein the blow-air openings are slidably arranged individually or in groups along the sweeping-roller brush.

7. Snow-clearing vehicle according to claim 6, wherein the outer blow-air opening which forms the beginning of the blow-airstream is slidable such that it is eventually positioned outside the area covered by the sweeping-roller brush.

8. Snow-clearing vehicle according to claim 1, wherein two or three blow-air openings each are arranged on a common carrier on each side of the vertical axis, wherein each carrier is adjustable along the sweeping-roller brush, and the corresponding blow-air openings are pivotably arranged on the carrier such that the angle of the corresponding blow-airstream to the sweeping-roller brush is adjustable in a horizontal plane.

9. Snow-clearing vehicle according to claim 1, wherein at least two blow-air openings are arranged in the direction of travel behind the sweeping-roller brush, which are arranged to pivot together with the sweeping-roller brush.

10. Snow-clearing vehicle according to claim 1, wherein it is a vehicle with its own drive and a snowplow in the front.

11. Snow-clearing vehicle according to claim 1, wherein it is a pullable vehicle without its own drive.

12. Snow-clearing vehicle according to claim 9, wherein blow-air is generated separately for one group of blow-air openings each.

13. Snow-clearing vehicle according to claim 1 wherein the blow-air openings are pivotably arranged individually or in groups for changing their blowing direction, and/or wherein the blow-air openings are slidably arranged individually or in groups along the sweeping-roller brush, said vehicle having an electronic control device which is designed for controlling the pivoting of the blow-air openings and/or for controlling the sliding of the blow-air openings.

14. Method for operating a sweeper-blower clearing vehicle having a right clearing side and a left clearing side, wherein an airstream is generated from at least four partially overlapping individual blow-airstreams by at least four identically and simultaneously acting blow-air openings along a sweeping-roller brush of the sweeper-blower clearing vehicle such that all said blow air openings act by blowing to the same clearing side of the vehicle; wherein said snow clearing vehicle is a vehicle having a sweeper-blower arrangement, wherein the sweeper-blower arrangement is adjustably pivotable around a vertical axis which runs through the snow-clearing vehicle, and wherein the sweeper-blower arrangement is provided with the sweeping-roller brush which is rotatingly drivable around its longitudinal axis, as well as with the plurality of blow-air openings arranged in the direction of travel in front and along the sweeping-roller brush on both sides of the vertical axis, wherein the sweeper-blower arrangement provides blow-air openings arranged on both sides of the vertical axis which are provided for simultaneous, identically acting blowing.

15. Method according to claim 14, wherein the blow-air openings are arranged substantially at the same distance from each other along the sweeping-roller brush and operated such that it results an essentially even combined blow-airstream along the sweeping-roller brush.

16. Method according to claim 14, wherein those blow-air openings which are located closer to the end of the overlapping blow-airstream, particularly the last two or the last three blow-air openings, are pivoted at a greater angle in the direction of travel than the other blow-air openings.

17. Method according to claim 14, wherein at least the blow-air opening arranged at the end of the sweeper-blower brush is shifted along the sweeper-blower brush until the shifted blow-air opening is located outside of the sweeping area of the sweeper-blower brush.

18. Method according to claim 14, wherein the blow-air openings are pivotably arranged individually or in groups for changing their blowing directions, and/or wherein the blow-air openings are slidably arranged individually or in groups along the sweeping-roller brush for changing their positions; and wherein different directions and/or positions of the blow-air openings are stored in and are retrievable from an electronic control of the snow-clearing vehicle.

19. Snow-clearing vehicle with a right clearing side and a left clearing side, having a sweeper-blower arrangement, wherein the sweeper-blower arrangement is adjustably pivotable around a vertical axis which runs through the snow-clearing vehicle, and wherein the sweeper-blower arrangement is provided with a sweeping-roller brush which is rotatingly drivable around its longitudinal axis, as well as with a plurality of blow-air openings arranged in the direction of travel in front and along the sweeping-roller brush on both sides of the vertical axis, wherein the sweeper-blower arrangement provides blow-air openings arranged on both sides of the vertical axis which are provided for simultaneous, identically acting blowing such that all said blow air openings on both sides of the vertical axis act by blowing snow to the same clearing side of the vehicle, wherein two or more blow-air openings are provided on each side of the vertical axis, and wherein the blow-air openings are pivotably arranged individually or in groups for changing their blowing direction.

20. Snow-clearing vehicle with a right clearing side and a left clearing side, having a sweeper-blower arrangement, wherein the sweeper-blower arrangement is adjustably pivotable around a vertical axis which runs through the snow-clearing vehicle, and wherein the sweeper-blower arrangement is provided with a sweeping-roller brush which is rotatingly drivable around its longitudinal axis, as well as with a plurality of blow-air openings arranged in the direction of travel in front and along the sweeping-roller brush on both sides of the vertical axis, wherein the sweeper-blower arrangement provides blow-air openings arranged on both sides of the vertical axis which are provided for simultaneous, identically acting blowing such that all said blow air openings on both sides of the vertical axis act by blowing snow to the same clearing side of the vehicle, wherein two or more blow-air openings are provided on each side of the vertical axis, and wherein the blow-air openings are pivotably arranged individually or in groups for changing their blowing direction and wherein the blow-air openings are slidably arranged individually or in groups along the sweeping-roller brush.

21. Snow-clearing vehicle according to claim 20, wherein the outer blow-air opening which forms the beginning of the blow-airstream is slidable such that it is eventually positioned outside the area covered by the sweeping-roller brush.

* * * * *